United States Patent [19]

Wada et al.

[11] Patent Number: 4,473,439

[45] Date of Patent: Sep. 25, 1984

[54] PROCESS FOR PULPING LIGNOCELLULOSIC MATERIAL

[75] Inventors: Isao Wada; Jun-Ichiro Kido; Wazuo Koido, all of Tokyo, Japan

[73] Assignee: Oji Paper Co., Ltd., Tokyo, Japan

[21] Appl. No.: 410,830

[22] Filed: Aug. 23, 1982

Related U.S. Application Data

[60] Division of Ser. No. 130,007, Mar. 13, 1980, Pat. No. 4,363,700, which is a continuation of Ser. No. 967,694, Dec. 8, 1978, abandoned.

[30] Foreign Application Priority Data

Dec. 14, 1977 [JP] Japan ..... 52-149195
Feb. 10, 1978 [JP] Japan ..... 53-13566

[51] Int. Cl.[3] ..... D21C 3/02; D21C 3/04; D21C 3/20

[52] U.S. Cl. ..... 162/72; 162/76; 162/82; 162/83

[58] Field of Search ..... 162/65, 72, 82, 83, 162/76, 78, 90

[56] References Cited

U.S. PATENT DOCUMENTS

| | | | |
|---|---|---|---|
| 4,012,280 | 3/1977 | Holton | 162/72 |
| 4,094,735 | 6/1978 | Holgersson | 162/76 |
| 4,178,861 | 12/1979 | Vanderhoek | 162/72 |
| 4,181,565 | 1/1980 | Nakamura et al. | 162/72 |
| 4,213,821 | 7/1980 | Vanderhoek | 162/72 |

OTHER PUBLICATIONS

Rydholm, "Pulping Processes", pp. 583–585, Interscience Publishers, N.Y. 1967.

*Primary Examiner*—Steve Alvo
*Attorney, Agent, or Firm*—Armstrong, Nikaido, Marmelstein & Kubovcik

[57] ABSTRACT

Lignocellulosic material is pulped with an alkaline sulfide cooking liquor which is characterized by containing a combination of a delignification-accelerating additive consisting of a quinone compound, hydroquinone compound, 9,10-diketohydroanthracene compound or 9,10-dihydroxyhydroanthracene compound, and a reducing additive consisting of a sulfite, hydrogen sulfite, thiosulfate or formate.

8 Claims, No Drawings

PROCESS FOR PULPING LIGNOCELLULOSIC MATERIAL

This is a division, of application Ser. No. 130,007, filed Mar. 13, 1980, U.S. Pat. No. 4,363,700 which is a continuation of Ser. No. 967,694, filed Dec. 8, 1978, abandoned.

FIELD OF THE INVENTION

The present invention relates to a process for pulping lignocellulosic material. More particularly, the present invention relates to a process for pulping lignocellulosic material at a high efficiency by using an alkaline sulfide kraft, or sulfate) pulping liquor.

BACKGROUND OF THE INVENTION

A process for pulping a lignocellulosic material, for example, wood, straw or bagasse, by using an alkaline sulfide cooking liquor containing, as main components, sodium sulfide and sodium hydroxide at an elevated temperature, is referred to as an alkaline sulfide pulping process. This alkaline sulfide pulping process, which includes kraft process, is a most important chemical pulping process due to its advantage in that the quality of the resultant pulp is higher than that of another pulping processes, for example, a sulfite pulping process. However, in the other hand, the conventional alkaline sulfide pulping process has a disadvantage in that the yield of the resultant pulp is relatively small.

In order to eliminate the above-mentioned disadvantage of the conventional alkaline sulfide pulping process, various approaches were looked into for accelerating the delignification reaction between the lignocellulosic material and the pulping liquor and for preventing the decomposition of the carbohydrates in the lignocellulosic material. In one approach for this purpose, a polysulfide compound, sodium borohydride, hydrazine, amine compound, aldehyde compound or nitrobenzene compound were added to the alkaline sulfide pulping liquor. In another approach, the wood chips were pretreated with hydrogen sulfide. In a further approach, the so-called alkafide method was developed. However, all of the above-mentioned approaches, except for the polysulfide process, have not yet been practically utilized due to the fact that the approaches cause the pulping apparatus to be expensive or complicated, the cost of the pulping operation to be very high, or the processability of the pulping process to be poor, or result in an environmental pollution or exhibit a poor effect in pulping hardwood.

Recently, since B. Bach and G. Fiehn, Zellstoff und Papier, vol 21, No. 1, pages 3 to 7 (1972) and related East German Patent No. 98,549 disclosed that the yield of pulp in the alkaline pulping process could be increased by adding an anthraquinone compound to the alkaline pulping liquor, various processes in which various anthraquinone compounds were used, were developed. For example, U.S. Pat. No. 3,888,727 disclosed a two-stage pulping process which comprised a first soda stage and second oxygen-alkali stage or a first kraft stage and second oxygen-alkali stage, and in which sodium anthraquinone-2-sulfonate (AMS) was added to the treating liquor in the first stage. Canadian Patent No. 986,662 disclosed a pulping process in which the lignocellulosic material was pre-treated with an alkali solution containing anthraquinone-2-monosulfonic acid. Japanese Patent Application Laying-open (KOKAI) No. 51-43403 disclosed a process in which a quinone compound was added to an alkali cooking liquor for a pulping process. West German Patent Application Laying-open (Offengungsschrift) No. 2,610,891 disclosed an oxygen-alkali pulping liquor containing a water-soluble oxygen carrier consisting of a quinone compound or hydroquinone compound. U.S. Pat. No. 4,012,280 disclosed an alkaline pulping liquor containing a sulphur free cyclic keto compound. U.S. Pat. No. 4,036,680 disclosed a soda pulping liquor containing a quinone compound and a nitro aromatic compound. Also, Japanese Patent Application Laying-open (KOKAI) No. 51-112903 disclosed a sulfite pulping process, wherein a cooking liquor contained a quinone compound.

In the above-mentioned prior arts, the quinone or hydroquinone compound alone or a combination of the quinone or hydroquinone compound and oxygen or an oxidizing agent were used for accelerating the delignification reaction and increasing the yield of the resultant pulp.

Furthermore, U.S. Pat. No. 4,036,680, issued to H. H. Holton, disclosed a soda pulping method in which a soda cooking liquor contains both a nitro aromatic compound and a diketohydroanthracene compound selected from unsubstituted and lower alkyl-substituted Diels-Alder adducts of naphthoquinone and benzoquinone. However, this method can not be applied to the pulping process in a reducing medium, such as the alkaline sulfide pulping process. This is because, when the nitro aromatic compound is added to the alkaline sulfide cooking liquor containing, as main components, sodium sulfide and sodium hydroxide, the nitro aromatic compound oxidizes the hydrosulfide ion derived from the sodium sulfide in the cooking liquor as reported by Svensk Papperstid, 71(23), 857–863(1968), so as to cause the sulfidity of the cooking liquor to be decreased. That is, the nitro aromatic compund itself is reduced so as to form a non-reactive compound.

It is already known from U.S. Pat. No. 2,938,913 that the diketohydroanthracene compound is readily oxidized by very mild oxidizing agents, for example, nitro compounds, hydrogen peroxide, chromic acid and air, so as to form an anthraquinone compound. Accordingly, it is evident that in the cooking liquor of the U.S. patent of Holton, the diketohydroantracene compound is oxidized into the anthraquinone compound by the nitro aromatic compound during the soda pulping process. That is, the process of the U.S. patent of Holton in which the combination of the nitro aromatic compound and the diketohydroanthracene compound is used, is substantially the same as the older soda pulping process in which the combination of the nitro aromatic compound and the anthraquinone compound is used. It is clear that the soda pulping process of the U.S. patent of Holton is carried out in an oxidizing condition.

The inventors of the present invention thoroughly studied the U.S. patent of Holton and found the fact that the addition of the combination of the nitro aromatic compound and the diketohydroanthracene compound to the alkaline sulfide pulping liquor which is in a reducing condition, caused the delignification reaction rate and the yield of the resultant pulp to be decreased, and the quality of the resultant pulp to become poor. That is, the combination of the nitro aromatic compound and the diketohydroanthracene compound is effective only for the soda pulping process which is carried out without using a reducing agent. The inventors also found the fact that, in the soda pulping process, the use of the diketohydroanthracene compound alone is not always more effective for increasing the delignification reaction rate and the yield of the resultant pulp than the use of the anthraquinone compound alone.

The inventors also studied in detail the pulping process using a cooking liquor containing a quinone compound. As a result of this study, it was found that $Na_2S$ and NaHS in the cooking liquor is active as a reducing agent only when the cooking liquor is in a weak alkaline condition or neutral condition and can reduce the quinone compound into the corresponding hydroquinone compound. For example, in the pulping process as disclosed in Japanese Patent Application Laying-open (KOKAI) No. 51-112903, a lignocellulosic material is treated with a sulfite cooking liquor containing a quinone compound at an elevated temperature under a pressurized condition. In this case, before the delignification reaction on the lignobellulosic material occurred, a deacetylation reaction or peeling reaction of the lignocellulosic material occurs. This deacetylation or peeling reaction causes the alkali in the alkaline sulfite cooking liquor to be consumed. As a result of this consumption, the sulfite cooking liquor exhibits a weak alkaline or neutral condition. Under this condition, NaHS can exhibit a high reducing activity and accelerate the reduction of the quinone compound into the corresponding hydroquinone compound.

However, it was also found by the inventors that in a strong alkaline cooking liquor, $Na_2S$ and NaHS can not exhibit the reducing activity. For example, in the alkaline sulfide pulping process, the cooking liquor containing sodium sulfide ($Na_2S$) and sodium hydrogen sulfide (NaHS) and sodium hydroxide can maintain its strong alkaline condition constant over the entire period of the delignification reaction. Accordingly, in the alkaline sulfide pulping process, the sodium sulfide can not exhibit the reducing activity for the quinone compound. Generally, the quinone compound such as naphthoquinone and anthraquinone has a very small solubility in the alkaline sulfide cooking liquor and only a small amount of the quinone compound can be reduced by carbohydrates in the lignocellulosic material into the corresponding hydroquinone compound which is generally soluble in the alkaline sulfide cooking liquor. The above-mentioned pulping process causes the lignin compounds in the lignocellulosic material to be converted into lignin radicals. The small amount of the resultant hydroquinone compound scavenges the lignin radicals so as to accelerate the delignification of the lignosellulosic material and the hydroquinone compound per se is oxidized into the quinone compound. That is, in the conventional delignification mixture, a redox oxidation-reduction system of the quinone compound and the corresponding hydroquinone compound is formed in the presence of the carbohydrates. However, this redox system is very small and, therefore, can not significantly accelerate the delignification of the lignocellulosic material.

As stated above, since the quinone compound can merely be reduced in a very small amount in the alkaline sulfide cooking liquor, it is clear that the quinone compound is not highly effective for accelerating the delignification of the lignocellulosic material with the alkaline sulfide cooking liquor.

It is also known that, in the conventional alkaline sulfide pulping process, an inorganic reducing compound, such as sodium sulfite, is not only ineffective for promoting the delignification but also tends to retard the delignification of the lignocellulosic material and to decrease the yield of the resultant pulp.

SUMMARY OF THE INVENTION

An object of the present invention is to provide a process for pulping lignocellulosic material with an alkaline sulfide cooking liquor at a high delignification reaction rate.

Another object of the present invention is to provide a process for pulping lignocellulosic material with an alkaline sulfide cooking liquor at a high yield of the resultant pulp having a high quality.

The above-mentioned objects can be attained by the process of the present invention which comprises: delignifying, at an elevated temperature, a lignocellulosic material with an alkaline sulfide cooking liquor containing, a delignification-accelerating additive consisting of at least one cyclic compound selected from the group consisting of quinone compounds, hydroquinone compounds, 9,10-diketohydroanthracene compounds, and 9,10-dihydroxyhydroanthracene compounds, and a reducing additive consisting of at least one inorganic compound selected from the group consisting of sulfites, hydrogen sulfites, thiosulfates and formates, and; separating the resultant delignified material from the delignifying mixture (spent liquor).

In the pulping process of the present invention, the quinone compound is reduced into the corresponding hydroquinone or semiquinone compound, not only by the action of the carbohydrates in the lignocellulosic material, but also by the action of the sodium sulfide in the presence of the inorganic reducing additive, while accelerating the oxidation of the lignin compound. Also, it is believed that the 9,10-diketohydroanthracene compounds in the alkaline sulfide cooking liquor are easily reduced into the corresponding anthraquinone compound. Moreover, the hydroquinone compound or the 9,10-dihydroxyhydroanthracene compound is oxidized into the corresponding quinone compound or the corresponding anthraquinone compound by scavenging the resultant lignin radical so as to accelerate the delignification.

That is, in the process of the present invention, the quinone and the corresponding hydroquinone compound (or the hydroquinone compound and the corresponding quinone compound) and the anthraquinone compound derived from the corresponding 9,10-diketohydroanthracene compound or 9,10-dihydroxyhydroanthracene compound, and the corresponding anthrahydroquinone compound, form, in the presence of the inorganic reducing additive, a large redox oxidation-reduction system different from the very small one formed by the action of the carbohydrates in the lignocellulosic material.

In this redox system, the oxidation and the reduction of the delignification-accelerating additive are alternately repeated continuously during the delignification reaction. Accordingly, even when the delignification accelerating additive is used in an extremely small amount of 0.01%, based on the bone dry weight of the lignocellulosic material, the delignification effect of the alkaline sulfide cooking liquor can be significantly increased.

DETAILED DESCRIPTION OF THE INVENTION

The process of the present invention is characterized in that the alkaline sulfide cooking liquor for pulping lignocellulosic material contains, in addition to sodium sulfide and sodium hydroxide, a combination of a delignification-accelerating additive and a reducing additive. Generally, the alkaline sulfide cooking liquor contains sodum sulfide and sodium hydroxide in amounts corresponding to the values of the content of effective alkali of from 8 to 40%, based on the bone dry weight of the lignocellulosic material, and a sulfidity of from 3 to 50%.

The delignification-accelerating additive consists of at least one cyclic organic compound selected from the group consisting of quinone compounds, hydroquinone compounds, 9,10-diketohydroanthracene compounds and 9,10-dihydroxyhydroanthracene compounds.

The quinone compound may be selected from the group consisting of naphthoquinone, anthraquinone, anthrone, phenanthrenequinone, and the alkyl, alkoxy, hydroxy, amino, sulfonic acid and carboxylic acid derivatives of the above-mentioned quinone compounds. From the point of view of economy, the preferable quinone compounds involve anthraquinone, 2-(or 1-) methyl anthraquinone, 2-(or 1-) methyl anthraquinone, 2-(or 1-) ethylanthraquinone, 2-(or 1-) aminoanthraquinone, anthraquinone-2-(or 1-) sulfonic acid salt, anthraquinone-2-(or 1-) carboxylic acid salt and 2-(or 1-) hydroxy anthraquinone. The most preferable quinone compound is anthraquinone.

The hydroquinone compound usable for the present invention may be selected from naphthohydroquinone, anthrahydroquinone, hydro-anthranol, phenanthrenehydroquinone and alkyl, alkoxy, hydroxy, amino, sulfonic acid and carboxylic acid derivatives of the above-mentioned hydroquinone compounds.

The 9,10-diketohydroanthracene compound usable for the present invention can be selected from the group consisting of 1,4-dihydro-9,10-diketoanthracene, 1,2,3,4-tetrahydro-9,10-diketoanthracene, 1,4,4a,9a-tetrahydro-9,10-diketoanthracene, 2-ethyl-1,4,4a,9a-tetrahydro-9,10-diketoanthracene, 2,3-dimethyl-1,4,4a,9a-tetrahydro-9,10-diketoanthracene, 1,3-dimethyl-1,4,4a,-9a-tetrahydro-9,10-diketoanthracene, 1-methyl-1,2,3,4-tetrahydro-9,10-diketoanthracene, 1,2,3,4,5,8-hexahydro-9,10-diketoanthracene, 1,4,4a,5,8,8a,9a,10a-octahydro-9,10-diketoanthracene, 2,3,6,7-tetramethyl-1,4,4a,5,8,8a,9a,10a-octahydro-9,10-diketoanthracene, 1,2,3,4,5,6,7,8-octahydro-9,10-diketoanthracene, 2,6-diethyl-1,4,4a,5,8,8a,9a,10a-octahydro-9,10-diketoanthracene, and 2,7-diethyl-1,4,4a,5,8,8a,9a,10a-octahydro-9,10-diketoanthracene. The preferable 9,10-diketohydroanthracene compound may be selected from the unsubstituted and lower alkyl substituted Diels-Alder adducts of naphthoquinone and benzoquinone. From the point of view of activity and economy, the most preferable 9,10-diketohydroxyanthracene compound is either 1,4,4a,9a-tetrahydro-9,10-diketoanthracene or 1,4,4a,5,8,8a,9a,10a-octahydro-9,10-diketoanthracene.

The 9,10-dihydroxyhydro anthracene compound usable for the present invention may be selected from the group consisting of 1,4-dihydro-9,10-dihydroxyanthracene, 1,4,5,8-tetrahydro-9,10-dihydroxyanthracene, 1,4,5,8,8a,10a-hexahydro-9,10-dihydroxyanthracene and sodium and potassium salts of the above-mentioned compounds.

It is preferable that the delignification-accelerating additive is used in an amount of from 0.01 to 5% based on the bone dry weight of the lignocellulosic material.

The reducing additive usable for the present invention consists of at least one inorganic reducing compound selected from the group consisting of sulfites, hydrogen sulfites, thiosulfates and formates. That is, the inorganic reducing compound is soluble in water and stable even at the elevated pulping temperature, and is preferably selected from sodium, potassium and ammonium sulfites, hydrogen sulfites, thiosulfates and formates. The more preferable reducing compounds are sodium sulfite, hydrogen sulfite, thiosulfite and formate which are easily obtainable from kraft pulp mills.

The reducing additive is used preferably in an amount of from 0.25 to 5% in terms of $Na_2O$, based on the bone dry weight of the lignocellulosic material.

As stated hereinbefore, in the alkaline sulfide cooking liquor, the sodium sulfide ($Na_2S$) and sodium hydrogen sulfide (NaHS) itself can not reduce the delignification-accelerating additive due to the high alkalinity of the cooking liquor, and the reducing additive itself also can not reduce the delignification-accelerating additive. However, the sodium sulfide can easily reduce the delignification-accelerating additive in the presence of the reducing additive.

The sodium sulfite and sodium hydrogen sulfite are readily obtained from a process for removing sulphur dioxide gas from waste exhaust gas generated from kraft pulp mills and various boilers in which heavy oil or a sulphur-containing fuel gas is burnt, by using sodium hydroxide. At the present time, excessively large amounts of the resultant sodium sulfite and sodium hydrogen sulfite are produced from the above-mentioned process. Therefore, large amounts of the produced sodium sulfite and sodium hydrogen sulfite are disposed of without being used.

In the kraft pulp mills, usually the sodium sulfite and sodium hydrogen sulfite which has been generated from the sulphur dioxide-removing process, are concentrated and burnt so as to convert them into sodium sulfide. The so resultant sodium sulfide is used for the pulping process. In the process of the present invention, a portion of the mixture of sodium sulfite and sodium hydrogen sulfite produced from the sulphur dioxide-removing process can be utilized as a reducing additive for the alkaline sulfide pulping process.

Due to the recent development of the sulphur dioxide-removing technology, the amount of sulphur discharged from the kraft pulp mills has become very small. This fact causes the sulfidity of the cooking liquor in the kraft pulping process to become high. The high sulfidity results in a high yield and high quality of the resultant pulp. However, this high sulfidity also causes the cooking liquor to emit a strong offensive smell. In order to avoide the generation of the offensive smell, the sulfidity of the cooking liquor should be kept at a relatively low level. However, in the conventional pulping process, it is difficult to maintain the sulfidity at a constant low level. Contrary to this, in the process of the present invention, the excessive amount of the sodium sulfide in the cooking liquor is converted into sodium thiosulfate by oxidizing it, and the resultant sodium thiosulfate can be utilized as a reducing additive for the alkaline sulfide pulping process. In the conventional alkaline sulfide pulping process not using the delignification-accelerating additive, the sodium thiosulfate itself is not effective for accelerating the delignification reaction. However, in the process of the present invention, the utilization of the sodium thiosulfate causes the delignification reaction to be accelerating and the sulfidity of the cooking liquor to be maintained at a proper low level. Preferably, the sulfidity of the cooking liquor is maintained at a level of from 3 to 50%, more preferably, from 5 to 30%.

The delignifying operation in the process of the present invention is preferably carried out at an elevated temperature of from 140° to 190° C., more preferably, from 145° to 180° C.

In the process of the present invention, when the delignifying operation is completed, the resultant delignified material is separated from the delignifying mixture (spent liquor) by means of filtration after that the delignified material is washed with water or an aqueous liquid inert to the lignocellulosic material, for example, the spent liquor from the later stage of an alkaline bleaching process or the "white water" from the later stage of a paper making process.

In the process of the present invention, the combination of the delignification-accelerating additive and the reducing additive is significantly effective for accelerating the delignification of the lignoscellulosic material involving not only wood, such as hardwood and softwood, but also bamboo stalk, bast fibers such as hemp, ramie, flax, jute fibers, straw and bagasse. The above-mentioned combination causes the content of alkali in the cooking liquor to decrease, and the yield and the quality of the resultant pulp to be improved in comparison with the conventional pulping process. The process of the present invention is also effective for maintaining the sulfidity of the cooking liquor at a proper low level.

The features and advantages of the process of the present invention are further illustrated by the examples set forth hereinafter, which are not intended to limit the scope of the present invention in any way. In the examples, the quality of the resultant pulp was evaluated by Kappa value which was determined in accordance with TAPPI method T-236 m-60, the viscosity was measured in accordane with TAPPI method T-230 SU-66, in which Cuprie-ethylenediamine solution was used for dissolving the pulp, and; the brightness was determined in accordance with JIS P8123 method.

EXAMPLES 1 THROUGH 6 AND COMPARISON EXAMPLES 1 THROUGH 4

In each of the Examples 1 through 6 and the Comparison Examples 1 through 4, 1700 g in air dry weight of beech chips were placed in an 8 liter autoclave and treated with an alkaline sulfide cooking liquor, in a ratio of the bone dry weight of the chips to the weight of the cooking liquor of 1:4, at a temperature as shown in Table 1, for a period of time as shown in Table 1. The cooking liquor contained sodium sulfide and sodium hydroxide, respectively, in amounts corresponding to the values of the content of effective alkali and the sulfidity indicated in Table 1, and; anthraquinone as a delignification-accelerating additive, and a reducing additive, respectively, in amounts shown in Table 1. The results are also shown in Table 1.

TABLE 1

| | Example | | | | | | | | | |
|---|---|---|---|---|---|---|---|---|---|---|
| | Comparison Example | | | | Example | | | | | |
| Item | 1 | 2 | 3 | 4 | 1 | 2 | 3 | 4 | 5 | 6 |
| Pulping process | | | | | | | | | | |
| Content of effective alkali (%)* | 15 | 15 | 14 | 14 | 13 | 13 | 13 | 13 | 13.5 | 13.5 |
| Sulfidity (%) | 25 | 25 | 25 | 25 | 25 | 25 | 25 | 25 | 25 | 25 |
| Temperature (°C.) | 165 | 165 | 165 | 165 | 165 | 165 | 165 | 165 | 165 | 165 |
| Time (min) | 70 | 70 | 80 | 70 | 70 | 70 | 70 | 60 | 70 | 70 |
| Content of anthraquinone (%)* | — | — | 0.02 | 0.1 | 0.02 | 0.05 | 0.05 | 0.05 | 0 .05 | 0.05 |
| Reducing additive | | | | | | | | | | |
| Compound | — | $Na_2SO_3$ | — | — | $Na_2SO_3$ | $Na_2SO_3$ | $Na_2SO_3$ | $Na_2SO_3$ | $Na_2S_2O_3$ | HCOONa |
| Content (%)* in terms of $Na_2O$ | — | 1.48 | — | — | 1.48 | 0.49 | 1.48 | 2.46 | 1.18 | 2.74 |
| Resultant pulp | | | | | | | | | | |
| Yield (%)* | 50.9 | 50.8 | 52.0 | 52.9 | 52.7 | 54.1 | 53.6 | 52.8 | 53.5 | 53.7 |
| Kappa number | 18.0 | 20.9 | 17.6 | 18.3 | 19.0 | 20.0 | 17.8 | 16.0 | 18.3 | 18.7 |
| Unbleached brightness (%) | 28.0 | 29.3 | 27.7 | 25.8 | 27.0 | 25.0 | 27.5 | 30.0 | 26.0 | 26.5 |
| Viscosity (cps) | 38.1 | 43.6 | 41.0 | 46.6 | 49.6 | 52.3 | 50.4 | 48.6 | 50.1 | 49.7 |

Note:
*Based on the bone dry weight of the chips.

Table 1 shows that, if the results of Comparison Example 1 are compared with those of Comparison Example 2, the addition of the reducing additive alone, without using anthraquinone, into the cooking liquor causes the delignification reaction to be retarded and the yield of the resultant pulp to be decreased. Also, Table 1 shows that, if the results of Comparison Example 3 are compared with those of Example 1 and the results of Comparison Example 4 are compared with those of Examples 2 to 4, the addition of both anthraquinone and the reducing additive causes the delignification reaction to be accelerated, and the yield and the viscosity of the resultant pulp to be increased. Furthermore, Table 1 shows that, if the results of Examples 2, 3 and 4 are compared with each other, the increase in the content of the reducing additive in the cooking liquor results in an increase in the unbleached brightness, and in a decrease in the yield, the kappa number and the viscosity of the resultant pulp. This phenomenon means that the increase in the content of the reducing additive causes the pulping effect of the cooking liquor to improve. Moreover, it is evident from a comparison of the results of Comparative Examples 3 and 4 with those of Examples 1 and 3, that the addition of sodium sulfite in an amount of 1.48% in terms of $Na_2O$ based on the bone dry weight of the chips allows the content of the effective alkali in the cooking liquor to decrease one percent or more. Also, the addition of 1.18, in terms of $Na_2O$, of sodium thiosulfate (Example 5) and 2.74%, in terms of $Na_2O$, of sodium formate (Example 6) permits the content of the effective alkali in the liquor to decrease 0.5% or more.

EXAMPLES 7 THROUGH 11 AND COMPARISON EXAMPLES 5 THROUGH 9

In each of the Examples 7 through 11 and Comparison Examples 5 through 9, 1700 g in air dry weight of beech chips were placed in an 8 liter autoclave and treated with an alkaline sulfide cooking liquor having the composition shown in Table 2, under treating conditions shown in Table 2. The ratio of the bone dry weight of the chips to the weight of the cooking liquor was 1:4. The results are also shown in Table 2.

TABLE 2

| ITEM | Comparison Example 5 | Example 7 | Comparison Example 6 | Example 8 | Comparison Example 7 | Example 9 | Comparison Example 8 | Example 10 | Comparison Example 9 | Example 11 |
|---|---|---|---|---|---|---|---|---|---|---|
| | EXAMPLE | | | | | | | | | |
| Pulping process | | | | | | | | | | |
| Content of effective alkali (%)* | 14 | 13 | 14 | 13 | 14 | 13 | 14 | 13 | 14 | 13 |
| Sulfidity (%) | 25 | 25 | 25 | 25 | 25 | 25 | 25 | 25 | 25 | 25 |
| Temperature (°C.) | 165 | 165 | 165 | 165 | 165 | 165 | 165 | 165 | 165 | 165 |
| Time (min) | 70 | 70 | 70 | 70 | 70 | 70 | 70 | 70 | 70 | 70 |
| Delignification-accelerating additive | | | | | | | | | | |
| Compound | Anthrahydroquinone | Anthrahydroquinone | AMS** | AMS** | 2-Hydroxyanthraquinone | 2-Hydroxyanthraquinone | 2-Ethylanthraquinone | 2-Ethylanthraquinone | 2-Aminoanthraquinone | 2-Aminoanthraquinone |
| Content (%)* | 0.1 | 0.05 | 0.1 | 0.05 | 0.1 | 0.05 | 0.1 | 0.05 | 0.1 | 0.05 |
| Content of $Na_2SO_3$ (%)* in terms of $Na_2O$ | — | 1.48 | — | 1.48 | — | 1.48 | — | 1.48 | — | 1.48 |
| Resultant pulp | | | | | | | | | | |
| Yield (%)* | 53.1 | 53.7 | 53.0 | 53.6 | 53.3 | 53.6 | 52.9 | 53.3 | 53.2 | 53.6 |
| Kappa number | 17.5 | 17.0 | 18.0 | 18.1 | 18.5 | 17.6 | 19.5 | 18.6 | 18.7 | 18.1 |
| Unbleached brightness (%) | 26.5 | 27.8 | 26.1 | 26.7 | 26.0 | 26.9 | 24.8 | 25.8 | 25.3 | 26.3 |
| Viscosity (cps) | 46.2 | 48.5 | 46.1 | 51.4 | 46.5 | 50.1 | 47.0 | 49.1 | 47.0 | 50.1 |

Note:
*Based on the bone dry weight of the chips
**AMS: Sodium anthraquinone-2-sulfonate With regard to Table 2, from the comparison of the results of Comparison Example 5 with those of Example 7, it is clear that even when a hydroquinone compound, which is a reduction product of the corresponding quinone compound, is used as a delignification-accelerating additive, the reducing additive, that is, $Na_2SO_3$, is effective for increasing the delignification effect of the cooking liquor. Also, the Comparison Examples 6 through 9 and the Examples 8 through 11 show that each of sodium anthraquinone-2-monosulfonate, 2-hydroxy-anthraquinone, 2-ethyl-anthraquinone and 2-amino-anthraquinone is effective for enabling the content of the effective alkali in the cooking liquor to be decreased 1% or more and for increasing the yield and viscosity of the resultant pulp.

EXAMPLES 12 THROUGH 15 AND COMPARISON EXAMPLES 10 THROUGH 14

In each of the Examples 12 through 15 and the Comparison Examples 10 through 14, 1500 g in air dry weight of Douglas-fir chips were placed in an 8 liter autoclave and pulped with an alkaline sulfide cooking liquor, having the composition shown in Table 3, under the pulping conditions shown in Table 3. The ratio of the bone dry weight of the chips to the weight of the cooking liquor was 1:4.5. The results are also shown in Table 3.

TABLE 3

| ITEM | Comparison Example 10 | Comparison Example 11 | Comparison Example 12 | Example 12 | Example 13 | Comparison Example 13 | Example 14 | Comparison Example 14 | Example 15 |
|---|---|---|---|---|---|---|---|---|---|
| | EXAMPLE | | | | | | | | |
| Pulping process | | | | | | | | | |
| Content of the effective alkali (%)* | 17 | 17 | 16 | 16 | 16 | 16 | 16 | 16 | 16 |
| Sulfidity (%) | 25 | 25 | 25 | 25 | 25 | 25 | 25 | 25 | 25 |
| Temperature (°C.) | 170 | 170 | 170 | 170 | 170 | 170 | 170 | 170 | 170 |
| Time (min) | 75 | 75 | 75 | 70 | 70 | 75 | 70 | 75 | 70 |
| Delignification-accelerating additive | | | | | | | | | |
| Compound | — | — | Anthraquinone | Anthraquinone | Anthraquinone | AMS** | AMS** | Anthrahydroquinone | Anthrahydroquinone |
| Content (%)* | — | — | 0.1 | 0.1 | 0.1 | 0.1 | 0.1 | 0.1 | 0.1 |
| Reducing additive | | | | | | | | | |
| Compound | — | $Na_2SO_3$ | — | $Na_2SO_3$ | $Na_2HSO_3$ | — | $Na_2SO_3$ | — | $Na_2SO_3$ |
| Content (%)* in terms of $Na_2O$ | — | 1.48 | — | 1.48 | 1.79 | — | 1.48 | — | 1.48 |
| Resultant pulp | | | | | | | | | |
| Yield (%)* | 46.5 | 47.1 | 48.0 | 48.5 | 48.7 | 48.0 | 48.2 | 48.0 | 48.5 |
| Kappa number | 34.0 | 39.8 | 34.6 | 32.4 | 33.5 | 36.4 | 33.1 | 33.5 | 31.3 |
| Unbleached brightness (%) | 20.3 | 17.8 | 19.9 | 20.3 | 20.5 | 19.5 | 20.1 | 21.7 | 22.0 |

TABLE 3-continued

| ITEM | EXAMPLE | | | | | | | | |
|---|---|---|---|---|---|---|---|---|---|
| | Comparison Example 10 | Comparison Example 11 | Comparison Example 12 | Example 12 | Example 13 | Comparison Example 13 | Example 14 | Comparison Example 14 | Example 15 |
| Viscosity (cps) | 41.6 | 46.7 | 43.1 | 44.5 | 43.5 | 44.5 | 44.1 | 44.0 | 44.3 |

Note:
*Based on the bone dry weight of the chips
**AMS: Sodium anthraquinone-2-sulfonate From the results of Comparison Examples 10 and 11 shown in Table 3, it is clear that, even in the case of a softwood such as Douglas-fir, the addition of the reducing additive alone, without addition of the delignification-accelerating additive, to the cooking liquor causes the pulping effect of the cooking liquid to be decreased.

If the pulping process of Comparison Example 11 is carried out to the extent that the resultant pulp exhibits a Kappa number similar to that of Comparison Example 10, the yield of the resultant pulp will be smaller than that of Comparison Example 10.

In view of the results of Comparative Examples 12 through 14 and Examples 12 through 15, it is evident that the reducing additive, such as $Na_2SO_2$, and $NaHSO_3$, is significantly effective for accelerating the delignification-accelerating effect of the quinone and the hydroquinone compounds for softwood, and also, for increasing the yield and the viscosity of the resultant pulp.

EXAMPLES 16 THROUGH 18 AND COMPARISON EXAMPLES 15 THROUGH 17

In each of Examples 16 through 18 and Comparison Examples 15 through 17, 1700 g in air dry weight of beech chips were placed in an 8 liter autoclave and pulped with a cooking liquor having the composition shown in Table 4, under pulping conditions shown in Table 4. The ratio of the bone dry weight of the chips to the weight of the cooking liquor was 1:4. The results are also shown in Table 4.

TABLE 4

| Item | Example | | | | | |
|---|---|---|---|---|---|---|
| | Comparison Example 15 | Example 16 | Comparison Example 16 | Example 17 | Comparison Example 17 | Example 18 |
| Pulping process | | | | | | |
| Content of effective alkali (%)* | 14 | 13 | 14 | 13 | 14 | 13 |
| Sulfidity (%) | 25 | 25 | 25 | 25 | 25 | 25 |
| Temperature (°C.) | 165 | 165 | 165 | 165 | 165 | 165 |
| Time (min) | 70 | 70 | 70 | 70 | 70 | 70 |
| Delignification-accelerating additive | | | | | | |
| Compound | A | A | B | B | C | C |
| Content (%)* | 0.1 | 0.05 | 0.1 | 0.05 | 0.1 | 0.05 |
| Reducing additive | | | | | | |
| Compound | — | $Na_2SO_3$ | — | $Na_2SO_3$ | — | $Na_2SO_3$ |
| Content (%)* in terms of $Na_2O$ | — | 1.48 | — | 1.48 | — | 1.48 |
| Resultant pulp | | | | | | |
| Yield (%)* | 53.4 | 54.0 | 53.3 | 53.8 | 53.6 | 54.2 |
| Kappa number | 17.2 | 16.6 | 17.0 | 16.7 | 16.8 | 16.3 |
| Unbleached brightness (%) | 27.0 | 28.4 | 27.3 | 29.1 | 27.8 | 30.1 |
| Viscosity (cps) | 47.0 | 50.3 | 46.5 | 50.0 | 47.6 | 49.4 |

Note:
*Based on the bone dry weight of the chips.
A 1,4,4a,9a-tetrahydro-9,10-diketoanthracene
B 1,4,4a,5,8,8a,9a,10a-octahydro-9,10-dikatoanthracene
C 1,4-dihydro-9,10-dihydroxyanthracene From a comparison of Example 16 with Comparison Example 15, Example 17 with Comparison Example 16 and Example 18 with Comparison Example 17, it is clear that the use of the reducing additive causes the content of the effective alkali in the cooking liquor to be allowed to be at a level of 1%, or more, less than that of the cooking liquor containing no reducing additive, and the yield and the viscosity of the resultant pulp to each be at a high level.

EXAMPLES 19 THROUGH 23

In each of Examples 19 through 23, 1700 g in air dry weight of beech chips were placed in an 8 liter autoclave and pulped with a cooking liquor having the composition shown in Table 5, under plupling conditions shown in Table 5. The ratio of the bone dry weight of the chips to the weight of the cooking liquor was 1:4. The results are also shown in Table 5.

TABLE 5

| Item | Example | | | | | |
|---|---|---|---|---|---|---|
| | Comparison Example 15 | Example 19 | 20 | 21 | 22 | 23 |
| Pulping process | | | | | | |
| Content of effective alkali (%)* | 14 | 13 | 13 | 13 | 13.5 | 13.5 |

TABLE 5-continued

| Item | Comparison Example 15 | Example 19 | Example 20 | Example 21 | Example 22 | Example 23 |
|---|---|---|---|---|---|---|
| Sulfidity (%) | 25 | 25 | 25 | 25 | 25 | 25 |
| Temperature (°C.) | 165 | 165 | 165 | 165 | 165 | 165 |
| Time (min) | 70 | 70 | 70 | 70 | 70 | 70 |
| Delignification-accelerating additive | | | | | | |
| Compound | A | A | A | A | A | A |
| Content (%)* | 0.1 | 0.05 | 0.05 | 0.05 | 0.05 | 0.05 |
| Reducing additive | | | | | | |
| Compound | — | $Na_2SO_3$ | $Na_2SO_3$ | $Na_2SO_3$ | $Na_2S_2O_3$ | HCOONa |
| Content (%)* in terms of $Na_2O$ | — | 0.49 | 1.48 | 2.46 | 1.18 | 2.74 |
| Resultant pulp | | | | | | |
| Yield (%)* | 53.4 | 54.9 | 54.0 | 53.6 | 53.4 | 53.8 |
| Kappa number | 17.2 | 19.7 | 16.6 | 15.7 | 17.5 | 17.6 |
| Unbleached brightness (%) | 27.0 | 27.3 | 28.4 | 31.7 | 27.5 | 27.0 |
| Viscosity (cps) | 47.0 | 53.0 | 50.3 | 48.1 | 48.7 | 49.4 |

Note:
*Based on the bone dry weight of the chips.
A 1,4,4a,9a-tetrahydro-9,10-diketoanthracene In view of Comparison Example 15 and Examples 19, 20 and 21, it is clear that an increase in the content of the reducing additive in the cooking liquor results in an increase in the delignification property of the cooking liquor, and in the yield and viscosity of the resultant pulp. Also, Examples 22 and 23 show thtat $Na_2S_2O_3$ and HCOONa are similarly effective for promoting the delignification effect of the cooking liquor to $Na_2SO_3$.

EXAMPLES 24 THROUGH 26 AND COMPARISON EXAMPLES 18 THROUGH 20

In each of Examples 24, 25 and 26 and Comparison Examples 18, 19 and 20, 1500 g in air dry weight of Douglas-fir chips were placed in an 8 liter autoclave and pulped with a cooking liquor having the composition shown in Table 6, under the pulping conditions shown in Table 6. The ratio of the bone dry weight of the chips to the weight of the cooking liquor was 1:4.5. The results are also shown in Table 6.

TABLE 6

| Item | Comparison Example 18 | Example 24 | Comparison Example 19 | Example 25 | Comparison Example 20 | Example 26 |
|---|---|---|---|---|---|---|
| Pulping process | | | | | | |
| Content of effective alkali (%)* | 16 | 16 | 16 | 16 | 16 | 16 |
| Sulfidity (%) | 25 | 25 | 25 | 25 | 25 | 25 |
| Temperature (°C.) | 170 | 170 | 170 | 170 | 170 | 170 |
| Time (min) | 75 | 70 | 75 | 70 | 75 | 70 |
| Delignification-accelerating additive | | | | | | |
| Compound | A | A | B | B | C | C |
| Content (%)* | 0.1 | 0.1 | 0.1 | 0.1 | 0.1 | 0.1 |
| Reducing additive | | | | | | |
| Compound | — | $Na_2SO_3$ | — | $Na_2SO_3$ | — | $Na_2SO_3$ |
| Content (%)* in terms of $Na_2O$ | — | 1.48 | — | 1.48 | — | 1.48 |
| Resultant pulp | | | | | | |
| Yield (%)* | 48.4 | 48.7 | 48.4 | 48.6 | 48.6 | 48.9 |
| Kappa number | 33.0 | 30.5 | 32.8 | 30.1 | 32.7 | 29.8 |
| Unbleached brightness (%) | 20.5 | 23.4 | 20.2 | 24.1 | 22.0 | 23.1 |
| Viscosity (cps) | 44.5 | 43.8 | 43.8 | 43.5 | 45.2 | 44.0 |

Note:
*Based on the bone dry weight of the chips.
A, B and C The same as those mentioned below Table 4.

Table 6 clearly shows that, even in the case of softwood, the combination of the 9,10-diketo-hydroanthracene or 9,10-dihydroxyhydroanthracene and the reducing additive is effective for accelerating the delignification of the lignocellulosic material.

What we claim is:

1. A process for pulping lignocellulosic material comprising delignifying, at a temperature of from 140° to 190° C., a lignocellulosic material with an alkaline sulfide cooking liquor containing:

(A) sodium sulfide;

(B) sodium hydroxide;

(C) a delignification-accelerating additive which consists of at least one cyclic organic compound selected from the group consisting of quinone compounds, hydroquinone compounds, 9,10-diketohydroanthracene compounds and 9,10-dihydroxyhydroanthracene compounds, and which is in an amount of from 0.01 to 5% based on the bone dry weight of said lignocellulosic material; and (D) a reducing assistant which consists of at least one compound selected from the group consisting of hydrogen sulfites, thiosulfates and formates of sodium and potassium, and which is an amount of from 0.25 to 5.0% in terms of $Na_2O$, based on the bone dry weight of the said lignocellulosic material, and separating the resultant delignified material from the delignifying mixture.

2. A process as claimed in claim 1, wherein said cyclic organic compound is selected from the group consisting of naphthoquinone, anthraquinone, anthrone, phenanthrenequinone and the alkyl, alkoxy, hydroxy, amino, sulfonic acid and carboxylic acid derivatives of the above-mentioned quinone compounds.

3. A process as claimed in claim 1, wherein said cyclic organic compound is selected from the group consisting of naphthohydroquinone, anthrahydroquinone, hydroanthranol, phenanthrenehydroquinone and the alkyl, alkoxy, hydroxy, amino, sulfonic acid and carboxylic acid derivatives of the above-mentioned hydroquinone compounds.

4. A process as claimed in claim 1, wherein said cyclic organic compound is selected from the group consisting of 1,4-dihydro-9,10-diketoanthracene, 1,2,3,4-tetrahydro-9,10-diketoanthracene, 1,4,4a,9a-tetrahydro-9,10-diketoanthracene, 2-ethyl-1,4,4a,9a-tetrahydro-9,10-diketoanthracene, 2,3-dimethyl-1,4,4a,9a-tetrahydro-9,10-diketoanthracene, 1,3-dimethyl-1,4,4a,9a-tetrahydro-9,10-diketoanthracene, 1-methyl-1,2,3,4-tetrahydro-9,10-diketoanthracene, 1,2,3,4,5,8-hexahydro-9,10-diketoanthracene, 1,4,4a,5,8,8a,9a,10a-octahydro-9,10-diketoanthracene, 2,3,6,7-tetramethyl-1,4,4a,5,8,8a,9a,10a-octahydro-9,10-diketoanthracene, 1,2,3,4,5,6,7,8-octahydro-9,10-diketoanthracene, 2,6-diethyl-1,4,4a,5,8,8a,9a,10a-octahydro-9,10-diketoanthracene and 2,7-diethyl-1,4,4a,5,8,8a,9a,10a-octahydro-9,10-diketoanthracene.

5. A process as claimed in claim 1, wherein said cyclic organic compound is selected from the group consisting of 1,4-dihydro-9,10-dihydroxyanthracene, 1,4,5,8-tetrahydro-9,10-dihydroxyanthracene, 1,4,5,8,8a,10a-hexahydro-9,10-dihydroxyanthracene and sodium and potassium salts of the above-mentioned compounds.

6. A process as claimed in claim 1, wherein said reducing assistant of thiosulfates is used in an amount of 0.49 to 5.0% in terms of $Na_2O$, based on the bone dry weight of said lignocellulosic material.

7. A process for pulping lignocellulosic material comprising delignifying at a temperature from 140° to 190° C., a lignocellulosic material with an alkaline sulfide cooking liquor containing:

(A) sodium sulfide;

(B) sodium hydroxide;

(C) a delignification-accelerating additive which consists of at least one cyclic organic compound selected from the group consisting of quinone compounds, hydroquinone compounds, 9,10-diketohydroanthracene compounds and 9,10-dihydroxyhydroanthracene compounds, and which is in an amount of from 0.01 to 5% based on the bone dry weight of said lignocellulosic material; and (D) a reducing assistant which consists of at least one compound selected from the group consisting of hydrogen sulfites, thiosulfates and formates of sodium and potassium, and which is in an amount of from 0.25 to 5.0% in terms of $Na_2O$, based on the bone dry weight of said lignocellulosic material, and separating the resultant delignified material from the delignifying mixture;

the sodium sulfide and sodium hydroxide being present in said alkaline sulfide cooking liquor in amounts to provide therein (i) an effective alkali content of from 8 to 40%; and (ii) a sulfidity of from 3 to 50%, both based on the bone dry weight of said lignocellulosic material.

8. A process as claimed in claim 7, wherein said reducing assistant of thiosulfates is used in an amount of 0.49 to 5.0% in terms of $Na_2O$, based on the bone dry weight of said lignocellulosic material.

* * * * *